US005140916A

United States Patent [19]

Williams

[11] Patent Number: 5,140,916

[45] Date of Patent: Aug. 25, 1992

[54] STAGED COMBUSTION OF FUEL OR SLUDGE TO REDUCE NITROUS OXIDE EMISSION

[76] Inventor: Robert M. Williams, 16 La Hacienda, Ladue, Mo. 63124

[21] Appl. No.: 804,008

[22] Filed: Dec. 9, 1991

[51] Int. Cl.[5] ..... F23D 1/00

[52] U.S. Cl. ..... 110/347; 110/186; 110/232; 110/233

[58] Field of Search ..... 110/232, 185, 186, 347, 110/233, 346, 345, 224

[56] References Cited

U.S. PATENT DOCUMENTS

| | | | |
|---|---|---|---|
| 4,489,664 | 12/1984 | Williams | 110/186 |
| 4,518,123 | 5/1985 | Tanaka et al. | 110/186 X |
| 4,640,204 | 2/1987 | Williams | 110/347 |
| 4,998,485 | 3/1991 | Williams | 110/234 |

*Primary Examiner*—Edward G. Favors
*Attorney, Agent, or Firm*—Polster, Lieder, Woodruff & Lucchesi

[57] ABSTRACT

A system and apparatus is disclosed for delivering fuel to a furnace using an inert gas medium which has acquired moisture from the application of the furnace stack gas for drying the incoming fuel material during the reduction of the fuel to a desired size for combustion in the furnace. The use of an oxygen deficient inert gases medium as a propellant to deliver the fuel to the furnace is augmented by supplying air to the furnace to establish a staged combustion environment in the furnace to avoid the generation of high levels of the pollutant nitrous oxide which is understood to be generated by high flame temperatures and with high oxygen and nitrogen concentrations.

10 Claims, 2 Drawing Sheets

STAGED COMBUSTION OF FUEL OR SLUDGE TO REDUCE NITROUS OXIDE EMISSION

BACKGROUND OF THE INVENTION

1. Field of the Invention

This invention is directed to a staged combustion of fuel in a furnace to control the output of nitrous oxide in the exhaust stack gas, and to apply the heat of the exhaust gas for drying the fuel processed in a grinding mill.

2. Description of the Prior Art

Combustion systems for the disposal of solid fuel in furnaces to utilize the heat of combustion to the production of electrical energy are disclosed in Hood U.S. Pat. No. 3,670,669 of Jun. 20, 1972 or Rouse U.S. Pat. No. 4,750,437 of Jun. 14, 1988. In these disclosures there is no teaching of control over the generations of objectionable levels of nitrous oxide emissions. It is known that fossil fuels when improperly burned produce a high order of nitric oxide. The improper burning occurs when the air is too excessive and the flame temperature is high. The control over the emissions of nitrous oxide is the concern of the present apparatus.

SUMMARY OF THE INVENTION

In accordance with the principles of the invention, the system for the control over the emission of objectional gases is accomplished by staged combustion of a fuel so a portion of the inert combustion gases is employed to dry incoming fuel and to feed the gases and a controlled quantity of air into the furnace to support combustion so that the flame temperature is reduced sufficiently to keep the nitrous oxide within narrow acceptable limits.

The invention also provides apparatus for operating a furnace to burn solid fuels in a combustion chamber by supplying air into the combustion chamber in cooperation with the supply of the prepared solid fuel at the level conveyed to the combustion chamber fuel bed by the use of recirculated inert combustion gases such that the air supply will establish staged combustion of the fuel in the fuel bed to limit flame temperature, and nitrous oxide.

Other advantages and features of the system of the invention and the apparatus by which the system is practiced will be set forth and become apparent as a description of apparatus and its function will appear.

BRIEF DESCRIPTION OF THE DRAWINGS

The invention referred to above is illustrated in relation to an embodiment of components connected in a cooperative organization to form apparatus suitable to practice the invention, wherein.

DETAILED DESCRIPTION OF THE EMBODIMENT

Figure 1:
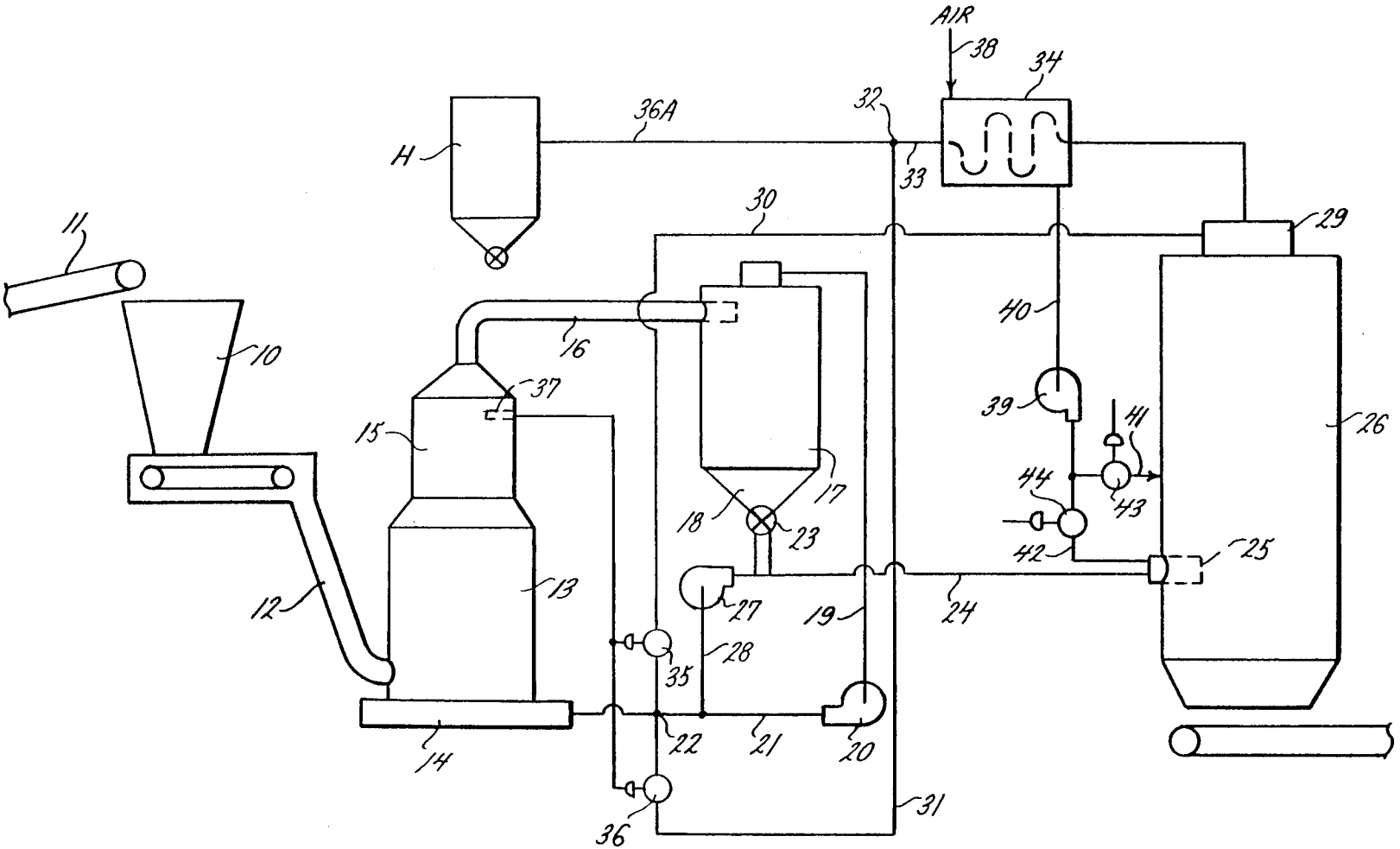
FIG. 1 is a schematic diagram showing a preferred semi-direct system and apparatus representing one embodiment of the invention.

In the drawing, the apparatus comprises a bin 10 in which material, such as coal or the like is deposited. The bin 10 is fed from a conveyor 11, or other suitable means, and the bin delivers the coal by belt conveyor into a chute 12 connected to the inlet of a grinding mill 13 having an air inlet box 14, and a classifier 15 which returns large particles for further reduction, while the acceptable particles flow into a conduit 16. The mill 13 may be an impact type or a roller type. That outflow of ground fuel moved in conduit 16 is conducted into a cyclone separater 17 where the solids are collected at 18 while the gases are separated and flow into conduit 19. Conduit 19 is connected into the suction of the blower 20 which forces the gases to return by conduit 21 to the mill inlet box 14 through the junction 22.

The outlet valve 23 at the cyclone 17 releases the solids into a conduit 24 which connects into a burner 25 in a furnace 26. The flow of the solids in conduit 24 is generated by a blower 27 having its inlet conduit 28 connected into conduit 21.

Combustion of the coal or fuel in furnace 26 is controlled by directing furnace flue gas from the stack outlet 29 which is at a temperature of the order of 1800° to 2000° F. That gas is drawn into conduit 30 to a junction 22 with conduit 21, and a second conduit 31 brings in gas at 350° F. The 350° F. gas is obtained from the connection at 32 at an outlet conduit 33 from a heat exchanger 34 that is connected into the furnace 26 at its outlet stack 29. Some of the heat exchanger gas is delivered by conduit 36A to a baghouse H before being released to the atmosphere free of solids. Control over adjusting the mix in the flow of the high temperature furnace stack gas and the lower temperature (350° F.) gas out of the heat exchanger 34 at the junction 22 is provided by a pair of controllable valves 35 and 36 responsive to the temperature sensor 37 in the classifier 15 of the mill for ground coal or fuel. Drying of the fuel in the mill 13 and classifier 15 is effected by mixing the high temperature gas from conduit 21 and the lower temperature gas from conduit 31 and feeding it into the air box 14. The sensor 37 regulates valves 35 and 36 to obtain the desired temperature of about 150° F. at the separator 15. It is noted that the control valve 35 is in the high temperature conduit 30 and the control valve 36 is in the low temperature conduit 31. Any suitable control (not shown) that can respond to the output signal from sensor 37 can adjust the valves 35 and 36 to a desired mix of the gases.

The system of utilizing the inert exhaust stack gases from the furnace to control the combustion is based on the transport of the fuel to the burner 25 of an inert media supplied by blower 20 that is sucked off at conduit 28 by a blower 27, and that blower 27 collects the solids from the cyclone 17 and uses the inert gas from conduit 21 to convey the fuel to the burner 25. Since the hot gases dry the fuel in the mill 13 and separator 15, the delivery in conduit 24 aided by a moist fuel slows the combustion and that lowers the development of the nitrous oxide ($NO_x$).

The combustion of the fuel in the furnace 26 is staged by the controlled delivery of ambient air from the inlet 38 at the heat exchanger 34 to the supply line 40 to the suction side of blower 39. The ambient air is heated and is delivered by conduit 41 to the furnace above burner 25, and by conduit 42 to or through the burner 25. Suitable controllable valves 43 and 44 in these respective conduits 41 and 42 are adjustable to regulate the combustion of the fuel in the furnace 26 so that sufficient air is made available to support the staged combustion of the fuel. Furnace ash is collected on conveyor 26A for removal in any usual way.

Figure 2:
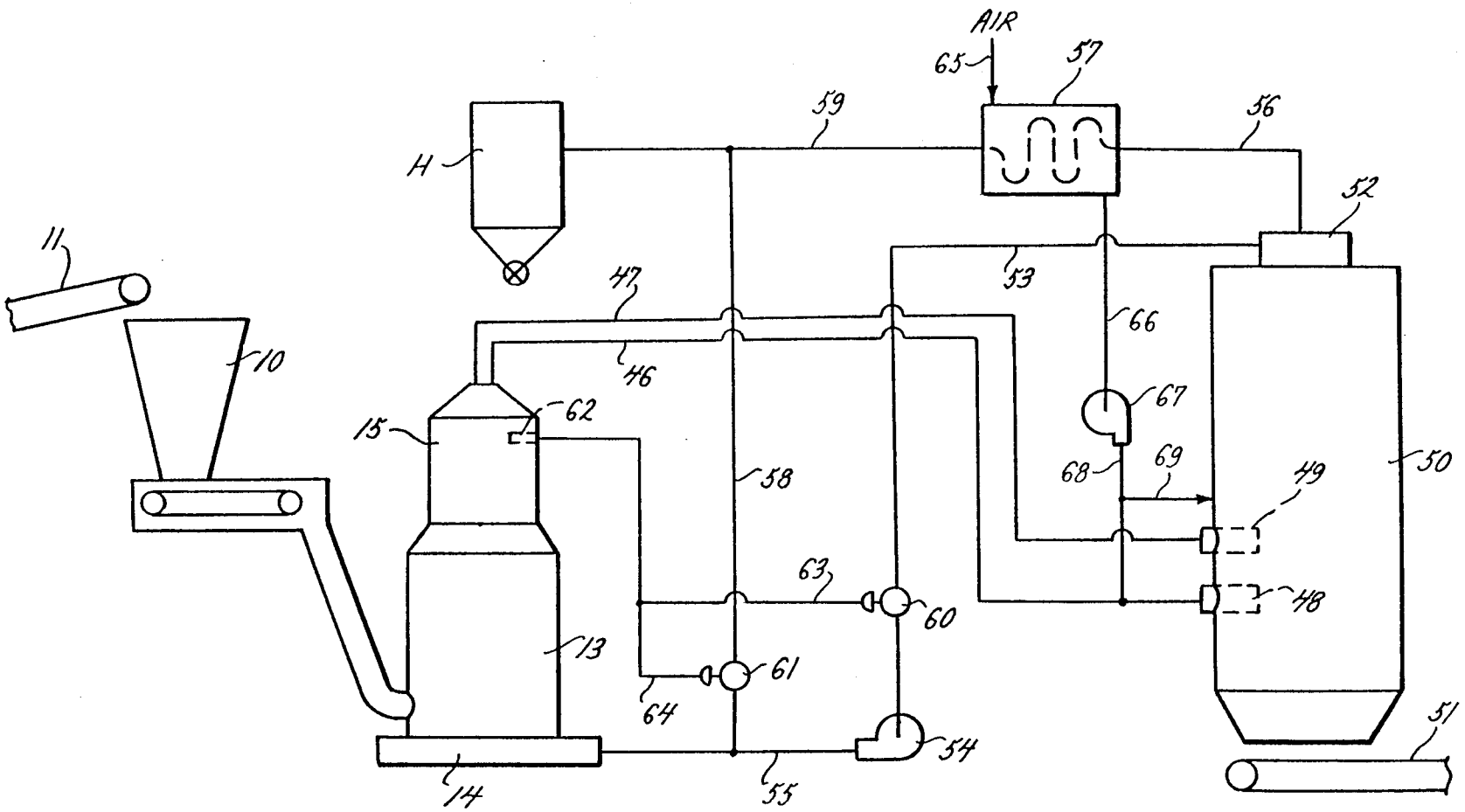
FIG. 2 is a diagram of a modification of the invention to show a furnace system with a direct fuel supply.

The embodiment seen in FIG. 2 is apparatus in which the prepared and ground and dried fuel is directly supplied to the furnace so that some of the components of apparatus referred to in FIG. 1 can be eliminated. Therefore, the ground and dried fuel from the separator 15 is conduced by conduits 46 and 47 directly into suitable burners 48 and 49 in the furnace 50. Ash is collected and discharged by conveyor 51. The furnace 50 has a stack 52 so that some of the hot combustion gases can be conveyed by conduit 53 into the suction side of blower 54. The blower 54 delivers the inert hot gas by conduit 55 to the mill air inlet 14. At the same time the blower 54 draws hot combustion gas from stack 52 through conduit 56 leading to a heat exchanger 57, and into a branch conduit 58 which connects into the outlet line 59 from the heat exchanger 57. The blower developed velocity in conduit 55 develops a negative pressure in conduit 58 which moves the stack gas into the heat exchanger 57 and conduit 59. The mixing of the gases in conduit 55 is controlled by valve 60 and 61 respectively in the conduit lines 53 and 58. These valves 60 and 61 are subject to control signals from the temperature sensor device 62 in the separator 15 of the mill 13. Signal lines 63 and 64 carry the signals from the sensor 62 to the respective valves 60 and 61.

The embodiment of FIG. 2 also includes a bag house H connected into the line 59 so that any residual particles that remain in the conduit 59 can be collected by the bag house H for disposal while the air is released to the atmosphere in the usual way. While the hot stack gas flows through the heat exchanger 57, outside air is admitted at line 65 to be heated before being drawn at the suction line 66 of fan 67. Fan 67 delivers the air into line 68 to feed combustion supporting air into line 46 for burner 48, while a branch line 69 delivers air directly into the furnace 50 adjacent the burner 49 that is supplied from line 47.

It will appear from the foregoing discription, and from the views in the accompanying drawings that a unique system (or method) is provided for limiting the production of obnoxious nitrous oxide emissions. The emissions are avoided by grinding the fuel in a mill in the presence of an inert gas which is then employed to convey the prepared ground fuel to a burner in a furnace. In one embodiment the ground fuel is delivered to the burner of a suitable furnace in a semi-direct system in which the solids collected in a cyclone are fed into the furnace. In a second embodiment the ground fuel is delivered directly into a furnace in parallel conduits to have a staged combustion. In each embodiment, a heat exchanger is employed to produce a low temperature flow of inert gas to mingle with the high temperature flow of inert gas for reducing the formation of nitrous oxide.

While the embodiments of this invention have been set forth with reference to specific organizations of apparatus that follow a common system of operation, it will be understood that modification may be included therein within the scope of the invention.

What is claimed is:

1. In a system for feeding fuel to a furnace under conditions of controlling the combustion to limit the production of obnoxious nitrous oxide emission levels, the system comprising:

(a) grinding a supply of fuel in an inert atmosphere to a particle size suitable for combustion;

(b) introducing the ground fuel into a furnace for combustion therein;

(c) moving a primary supply of hot combustion inert gas from the furnace into the supply of fuel during the grinding thereof at a first temperature level for drying the fuel during the grinding thereof in an inert atmosphere;

(d) providing a secondary supply of inert gas from the furnace at a second temperature level less than said first temperature level of the primary supply of hot combustion gases for tempering the temperature of the ground fuel supply for combustion; and (e) adding a supply of oxygen to the supply of ground fuel at the furnace in such quantity as to support the combustion of the fuel in the furnace in a temperature range which limits the nitrous oxide emissions.

2. The system set forth in claim 1 wherein the grinding of a supply of fuel is subjected to separation of particles unsuited for combustion for regrinding, means for controlling the primary and secondary supply of inert gas such that the mixing of the primary and secondary supply of inert gas during grinding of the supply of fuel developes a tertiary temperature level.

3. The system set forth in claim 1 wherein the primary supply of hot combustion inert gas and the secondary supply of inert gas are comingled prior to introducing the comingled inert gases into the grinding of the supply of fuel.

4. The system set forth in claim 3 wherein the comingled inert gases transport the supply of ground fuel into the furnace for combustion therein.

5. The system set forth in claim 3 wherein the secondary supply of inert gas is directed through a heat exchanger for temperature reduction in advance of being comingled with the primary supply of hot inert gas.

6. In apparatus for operating a furnace with a supply of fuel to control the combustion of the fuel so as to limit the emission of nitrous oxide to the atmosphere, the apparatus comprising:

(a) a supply of fuel;

(b) a furnace for the combustion of said supply of fuel and being formed with a hot gas outlet stock;

(c) means for reducing the supply of fuel to a particle size for combustion in said furnace prior to delivery to said furnace; and (d) means interconnecting said fuel reducing means and said furnace, including:

(1) blower means having a suction inlet connected to said furnace outlet stack and an outlet conduit connected to said fuel reducing means for conducting hot combustion inert gas to said fuel reducing means to effect moisture reduction, and to apply the hot inert gas as the medium to transport the ground fuel to the furnace from said fuel reducing means;

(2) conduit means connected to said furnace outlet stack and extending into a connection into said blower outlet conduit for delivery of additional combustion gas;

(3) heat exchanger means inserted in said last mentioned conduit means for effecting a temperature reduction of the additional combustion gas; and (4) other blower means connected to said furnace for delivery of air into said furnace for supporting the combustion of fuel delivered to said furnace at a temperature conducive to low nitrous oxide release.

7. The apparatus set forth in claim 6 wherein said means interconnecting said fuel reducing means with said furnace further includes means to effect separation of the particle size of the fuel from the inert transport gas, and to apply the inert transport gas to effect delivery of the separated particle size of the fuel to said furnace.

8. The apparatus set forth in claim 6 wherein said other blower means draws ambient air through said heat exchanger for raising the temperature of the ambient air, and conduit connecting means extending from said other blower into said furnace to support staged combustion of the fuel in said furnace.

9. The apparatus set forth in claim 6 wherein a bag house is connected into said heat exchanger for removing residual solids carried out of said furnace stack, and outlet means in said bag house to release combustion gas to the ambient air following the cooling thereof by said heat exchanger.

10. The apparatus set forth in claim 6 wherein said means interconnecting said fuel reducing means and said furnace includes a pair of conduits having separate connections into said furnace to effect staged combustion of the reduced fuel.

* * * * *